US012018415B2

(12) United States Patent
Hahm et al.

(10) Patent No.: US 12,018,415 B2
(45) Date of Patent: Jun. 25, 2024

(54) METHOD FOR MANUFACTURING MELT-SPUN NONWOVEN FABRIC AND MICROFIBER NONWOVEN WEB MANUFACTURED THEREFROM

(71) Applicant: KOREA INSTITUTE OF INDUSTRIAL TECHNOLOGY, Cheonan-si (KR)

(72) Inventors: Wan Gyu Hahm, Cheonan-si (KR); Byeong Jin Yeang, Hwaseong-si (KR); Young Chan Choi, Ansan-si (KR); Hyun Ju Oh, Yongin-si (KR)

(73) Assignee: KOREA INSTITUTE OF INDUSTRIAL TECHNOLOGY, Chungcheongnam-Do (KR)

( * ) Notice: Subject to any disclaimer, the term of this patent is extended or adjusted under 35 U.S.C. 154(b) by 336 days.

(21) Appl. No.: 17/292,718

(22) PCT Filed: Dec. 2, 2019

(86) PCT No.: PCT/KR2019/016831
§ 371 (c)(1),
(2) Date: May 11, 2021

(87) PCT Pub. No.: WO2020/111910
PCT Pub. Date: Jun. 4, 2020

(65) Prior Publication Data

US 2022/0002922 A1 Jan. 6, 2022

(30) Foreign Application Priority Data

Nov. 30, 2018 (KR) ..... 10-2018-0152802
Nov. 20, 2019 (KR) ..... 10-2019-0149432

(51) Int. Cl.
*D04H 1/4291* (2012.01)
*D01D 5/08* (2006.01)

(52) U.S. Cl.
CPC ..... *D04H 1/4291* (2013.01); *D01D 5/08* (2013.01); *D10B 2321/022* (2013.01); *D10B 2331/04* (2013.01)

(58) Field of Classification Search
CPC ..... D04H 3/007; D04H 3/16; D04H 3/011; D04H 3/14; D04H 3/016; D04H 1/4291;
(Continued)

(56) References Cited

U.S. PATENT DOCUMENTS 10,422,052 B2 * 9/2019 Hahm ..... D01D 5/32
2018/0051392 A1 * 2/2018 Hahm ..... D01F 8/06

FOREIGN PATENT DOCUMENTS

KR 10-2017-0105746 A 9/2017

OTHER PUBLICATIONS

International Search Report dated Apr. 3, 2020 for PCT/KR2019/016831.

* cited by examiner

*Primary Examiner* — Monica A Huson
(74) *Attorney, Agent, or Firm* — CANTOR COLBURN LLP

(57) ABSTRACT

The present invention relates to a method for manufacturing a melt-spun nonwoven fabric and a microfiber nonwoven web manufactured therefrom. The present invention relates to a method for manufacturing a melt-spun nonwoven fabric, in which fibers obtained by melt-spinning a thermoplastic polymer through a spinning nozzle including at least one nozzle hole are collected by high-speed air stream, wherein the melt-spun fibers are subjected to momentary local heating at a high temperature higher than a spinning temperature while same are caused to pass through a nozzle local heating provided directly under the spinning nozzle during spinning, so that the method can lower the melt flow index and spinline elongation viscosity of a thermoplastic
(Continued)

resin discharged from the nozzle hole without reducing a molecular weight, thereby providing a microfiber nonwoven web formed by finely thin fibers, compared to the conventional spun-bond nonwoven fabric.

6 Claims, 11 Drawing Sheets

(58) Field of Classification Search
CPC . D01D 5/08; D10B 2321/022; D10B 2331/04
See application file for complete search history.

(a)

(b)

METHOD FOR MANUFACTURING MELT-SPUN NONWOVEN FABRIC AND MICROFIBER NONWOVEN WEB MANUFACTURED THEREFROM

TECHNICAL FIELD

The present invention relates to a method for manufacturing a melt-spun nonwoven fabric and a microfiber nonwoven web manufactured thereby, and more particularly, to a method for manufacturing a melt-spun nonwoven fabric, in which fibers obtained by melt-spinning a thermoplastic polymer through a spinning nozzle having at least one or more nozzle holes are collected by high-speed air stream, including the steps of allowing the melt-spun fibers to be subjected to momentary local heating to a higher temperature than a spinning temperature, while passing through local nozzle heaters provided directly under the spinning nozzle during the spinning, so that the method can lower melt flow indexes and spinline elongational viscosity of the thermoplastic resins discharged from the nozzle holes, without reducing molecular weights, thereby providing a microfiber nonwoven fabric formed of more fine fibers when compared to conventional spunbond nonwoven fabrics.

BACKGROUND ART

Nonwoven fabrics are used in wide applications such as medical materials, industrial materials, construction materials in civil engineering, agricultural and gardening materials, living-related materials, and sanitary materials, and so on. Among the nonwoven fabrics, advantageously, the nonwoven fabric made from long fibers has more uniform and excellent physical properties and higher productivity than that made from short fibers. So as to produce a nonwoven fabric having excellent functionality as well as the advantages of the nonwoven fabric made from long fibers, there have been many studies on fiber fineness through which fibers constituting the nonwoven fabric are fine as thinly as possible.

Accordingly, the fiber fineness of the nonwoven fabric products is one of important issues, and as the fiber is fine, the specific surface area of the nonwoven fabric is drastically increased to thus optimize liquid absorption, softness or flexibility, and filtering performance, so that the nonwoven fabric can be usefully used in improving the performance in various applications including sanitary materials and filters.

An effective method for manufacturing a melt-spun nonwoven fabric includes a spunbond method and a meltblown method.

The spunbond method is a method for manufacturing a nonwoven fabric made from long fibers, and through the spunbond method, a spunbond nonwoven fabric is first produced by DuPont in 1959 and is widely used up to now.

FIG. 1 is a schematic diagram showing a method for manufacturing a synthetic fiber through typical melt spinning, and as shown, a thermoplastic polymer fed to a hopper 100 is melted and discharged through an extruder 101 and is extruded and spun through a nozzle 104 having fine holes. Next, the spun thermoplastic polymer is subjected to cooling and fineness processes, and in the fineness process, the fiber is manufactured through a winder 105 using a roller 104.

FIG. 2 is a schematic diagram showing method for manufacturing a nonwoven fabric through an open type spunbond method using melt spinning, and instead of the winder using the roller as shown in FIG. 1, the fiber is drawn and finely thin through high-speed air stream generated from an ejector 204 to produce a spunbond nonwoven fabric on a web structure through a moving and collecting conveyor belt located under the elector 204.

FIG. 3 is a schematic diagram showing a method for manufacturing a nonwoven fabric through a closed type spunbond method using melt spinning, and instead of the winder using the roller as shown in FIG. 1, fibers are cooled through the air fed from nozzles of a closed type duct. In this case, a fiber passing area of the duct is drastically reduced in the lower stream of the fibers to optimize an air passing speed in the duct, so that in the similar manner to the open type ejector, the fibers are drawn and finely thin through high-speed air stream to produce a spunbond nonwoven fabric on a web structure through a moving and collecting conveyor belt located under the duct.

Accordingly, final running speeds or deniers of the fibers manufactured by the melt-spun method on the spinlines are adjusted according to spinning conditions like discharge amounts from the nozzle holes, winding speeds, and so on, but in the case of the spunbond nonwoven fabric, they are determined according to the discharge amounts from the nozzle holes and the air pressure and amount outputted from the elector.

The nonwoven fabrics made from continuous fibers in the spunbond method have excellent mechanical strength, but they have small surface areas due to large diameters of the fibers, thereby showing bad fluid absorption, flexibility and filtering characteristics.

So as to achieve the fiber fineness of the nonwoven fabric, accordingly, it is reported that if the air pressure of the ejector was increased or the discharge amounts from the nozzle holes were decreased in the spunbond method, the fiber running speeds were raised to produce the nonwoven fabric made from more fine fibers [Non-Patent Document 1].

FIG. 4 is a schematic diagram showing a method for manufacturing a nonwoven fabric through a meltblown method using melt spinning.

The meltblown method makes use of melt spinning in a similar manner to the spunbond method [Non-Patent Document 2], but when compared to the spunbond nonwoven fabric, a meltblown nonwoven fabric has a smaller fiber diameter, better flexibility, and a larger surface area. So as to obtain fiber fineness through the meltblown method, a low viscosity thermoplastic polymer having a low molecular weight is melted, and when the polymer is elected from a nozzle, high temperature air is applied to the nozzle to a speed close to the speed of sound, thereby mass-producing microfiber nonwoven fibers of 1 to 3 μm.

However, the microfiber nonwoven fabric produced by the meltblown method has a large amount of energy consumed in process and makes use of the thermoplastic polymer having the low molecular weight so as to obtain the fiber fineness, so that the microfiber nonwoven fabric itself has low mechanical strength. Accordingly, the microfiber nonwoven fabric is not used alone, but used combinedly with the conventional spunbond nonwoven fabric.

In addition thereto, microfibers are manufactured through electrospinning, and in this case, a polymer is melted through a solvent and is spun by means of a voltage difference under high pressure electric loading, while at the same time the solvent becomes volatile and removed, thereby obtaining nano-sized microfibers. In the case using the electrospinning, however, the productivity of microfibers is remarkably reduced, and it is hard to remove the remaining solvent thereon, thereby having limitations in application to sanitary materials and filters. Further, the microfibers produced through electrospnning have very weak physical properties, so that they may be generally used combinedly with the conventional spunbond fibers.

A flash spinning method as another method includes the steps of uniformly dissolving a polymer into a solvent like liquefied gas to a high pressure at a higher temperature than a melting point, a little reducing a pressure of the polymer before an outlet of a nozzle to divide the polymer into two components in phase, discharging the polymer into the air with normal temperature and pressure to drastically gasify the solvent, allowing the solvent to flow at a supersonic speed, and simultaneously vaporizing the solvent. In this case, the remaining polymer is solidified and stretched to obtain 0.1 denier microfiber nonwoven fabric having excellent physical properties [Patent Document 2].

However, the flash spinning method is very complicated and hard to be controlled, and accordingly, it may be applied limitedly to olefin polymers.

As shown in FIG. 1, the melt spinning method for manufacturing the synthetic fiber heats and melts the polymer to a higher temperature than the melting point and extrudes and cools the polymer from the spinning nozzle, thereby manufacturing the synthetic fiber. In this case, good physical properties of the synthetic fiber, particularly, high strength synthetic fiber can be obtained through the stable cooling method for the spun fiber discharged from the spinning nozzle. To do this, conventional studies are conducted to control the formation behaviors of the fiber structure through the molecular orientation and crystallization of the cooled and solidified fiber or to delay the cooling to obtain the high strength of the fiber.

For example, the fiber is locally heated just under the spinning nozzle by means of temperature keeping or laser irradiation, but the local heating just serves to heat a given portion of the fiber that contacts heat or laser under the spinning nozzle, so that the local heating is not heating, but keeping temperature. Through the local heating, that is, the entire fiber cannot be uniformly heated.

Accordingly, polyethylene terephthalate (PET) or nylon non-liquid-crystal thermoplastic polymers are complicated in structure where the chains of the polymers in a melted state are entangled in the form of random non-liquid-crystal coils, and even if high shear stress and a drawing rate (draft and drawing ratio) from the spinning nozzle are applied, accordingly, it is hard to control the molecular entanglement structure in the form of the random coils in the melted polymers, thereby failing to achieve complete orientation and crystallization (high strength).

On the other hand, it is reported by this inventors that a nozzle heating mantle for optimizing local heating was located just under the spinning nozzle through which the melted resin passes after spun, so that the whole fibers spun around the holes of the spinning nozzle and just under the spinning nozzle were subjected to momentary local heating to a high temperature to control the molecular entanglement structure of the polymer, thereby improving the mechanical properties of the synthetic fiber, such as strength, elongation, and so on [Patent Document 3].

So as to solve the problems occurring in the conventional methods for manufacturing the microfiber nonwoven fabric, this inventors suggest that the fibers around the holes of the spinning nozzle and just under the spinning nozzle are subjected to direct and indirect momentary local heating to a high temperature in the melt spinning process, thereby lowering the pressure of the spinning nozzle, decreasing the fiber tensile between the spinning nozzle and the elector, effectively controlling the molecular entanglement structure in the polymer, without any decrease in the molecular weight, increasing the spinning speed of the fibers from the ejector, and finally obtaining the microfiber nonwoven web made from more fine fibers when compared to the conventional spunbond or meltblown nonwoven fabric.

DISCLOSURE

Technical Problem

Accordingly, the present invention has been made in view of the above-mentioned problems occurring in the related art, and it is an object of the present invention to provide a method for manufacturing a melt-spun nonwoven fabric that is capable of allowing fibers to be subjected to momentary local heating to a high temperature during melt spinning.

It is another object of the present invention to provide a microfiber nonwoven web manufactured by a method for manufacturing a melt-spun nonwoven fabric.

It is yet another object of the present invention to provide a use including a microfiber nonwoven web manufactured by a method for manufacturing a melt-spun nonwoven fabric.

Technical Solution

To accomplish the above-mentioned objects, according to one aspect of the present invention, there is provided a method for manufacturing a melt-spun none oven fabric, in which fibers obtained by melt spinning a thermoplastic polymer through a spinning nozzle having at least one or more nozzle holes are collected by high-speed air stream according to a spunbond method, the method including the steps of: allowing the melt-spun fibers to pass through local nozzle heaters of a nozzle heating mantle located just on the underside of the spinning nozzle during the spinning; and allowing the melt-spun fibers to be subjected to momentary local heating with a temperature difference of 0.1 to 1,000° C. from a temperature of a pack body.

According to the present invention, the local nozzle heaters have the corresponding number of heating holes to the at least one or more nozzle holes in such a manner as to be spaced apart from the centers of the nozzle holes by 1 to 300 mm.

According to the present invention, if the nozzle holes are arranged with a plurality of hole layers on the same radius as one another to allow the local nozzle heaters to be inserted into the neighboring hole layers to band forms, the local nozzle heaters have band type heating holes arranged in series within a distance of 1 to 300 mm from the centers of the nozzle holes.

According to the present invention, the thermoplastic polymer is any one selected from a polyester polymer selected from the group consisting of polyethylene terephthalate (PET), polybutylene terephthalate (PET), poly trimethylene terephthalate (PTT), polyethylene dimethanonol terephthalate (PCT), polyethylene naphthalate (PEN), and polyarylate; a polyamide polymer selected from the Group consisting of nylon 6, nylon 6,6, nylon 4, and nylon 4, 6; a polyolefin polymer selected from polyethylene and polypropylene; and polyphenylen sulfide (PPS), or a combination of two or more thereof.

According to the present invention, the nozzle heating mantle is formed with a lower peripheral surface of the spinning nozzle, which is inserted into the pack body by 50 mm and is exposed to the outside of the pack body by 300 mm with respect to the lower peripheral surface of the pack body, with an insertion depth of 0 to 50 mm of each local nozzle heater, which comes into contact with the underside of the spinning nozzle or is partially inserted into the spinning nozzle, and with a length of 5 to 500 mm of each local nozzle heater, the nozzle heating mantle being formed with the insertion depth of each local nozzle heater whose portion is inserted into the underside of the spinning nozzle and with the extension length of each local nozzle heater from the insertion depth.

According to the present invention, the additional extension distance to the outlet of each nozzle hole from the underside of the spinning nozzle is in the range of 0 to 100 mm, and the gap between the nozzle holes in the extended section is in the range of 0 to 100 mm.

According to the present invention, the spinning nozzle has a fluid mixer located in an upper flow path pipe of each nozzle hole.

To accomplish the above-mentioned objects, according to another aspect of the present invention, there is provided a microfiber nonwoven web manufactured by the above-mentioned method according to the present invention by allowing polypropylene (PP) having a melt flow index (MFI) of 3 to 900 to be subjected to momentary local heating to a high temperature during the spinning to thus perform fiber fineness.

According to the present invention, the fiber fineness satisfies a fineness value or less calculated by the following equation 1:

$$\text{Fineness } (\mu m)=94\times A^{(-0.71)} \qquad \text{Equation 1}$$

wherein A indicates the MFI of the fibers constituting a spunbond nonwoven fabric when pure PP having no additive or modifying agent is used.

To accomplish the above-mentioned objects, according to yet another aspect of the present invention, there is provided a microfiber nonwoven web manufactured by the above-mentioned method according to the present invention by allowing polyethylene terephthalate (PET) having intrinsic viscosity (I.V.) of 0.5 to 3.0 to be subjected to momentary local heating to a high temperature during the spinning to thus perform fiber fineness.

According to the present invention, the fiber fineness satisfies a fineness value or less calculated by the following equation 1:

$$\text{Fineness } (\mu m)=(34\times B)-12.7 \qquad \text{Equation 2}$$

wherein B indicates the intrinsic viscosity of the fibers constituting a spunbond nonwoven fabric when pure PET having no additive or modifying agent is used.

Advantageous Effects

According to the present invention, the method is carried out by allowing the fibers around the holes of the spinning nozzle and just under the spinning nozzle to be subjected to direct and indirect momentary local heating to the high temperature in the melt spinning of the spunbond method, thereby obtaining the microfiber nonwoven web made from the more fine fibers when compared to the conventional spunbond nonwoven fabric.

Further, the method according to the present invention still utilizes the conventional spunbond method, thereby lowering an initial investment cost and mass-producing the high value and high functional microfiber nonwoven fabric at a low cost.

So as to satisfy the same denier and physical properties as in the nonwoven fabric manufactured by the conventional spunbond method, further, the method according to the present invention can increase the amount of the thermoplastic polymer discharged initially as the spinning speeds of the melted fibers discharged from the spinning nozzle are raised by means of the local heating occurring when the fibers pass through the heating holes, thereby improving the productivity of the nonwoven fabric.

In specific, the method according to the present invention is carried out by allowing the melt-spun fibers to be subjected to the momentary local heating to the high temperature, so that the pack pressure becomes lowered to permit the thermoplastic polymer with high viscosity to be spunable, thereby providing the microfiber nonwoven web.

Also, the method according to the present invention is usefully applied for filtering or sanitary materials including the microfiber nonwoven web manufactured thereby.

MODE FOR INVENTION

Hereinafter, an explanation on the present invention will be in detail given with reference to the attached drawings.

Figure 1:
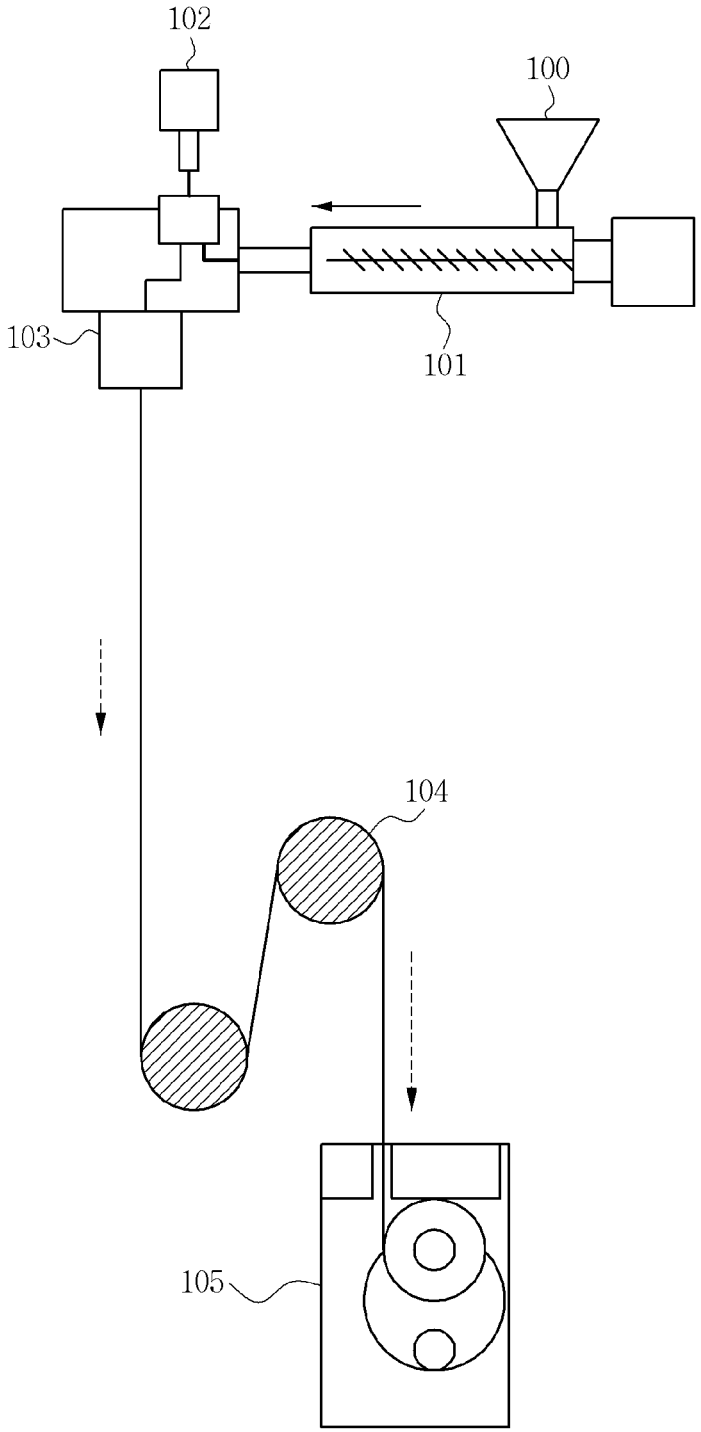
FIG. 1 is a schematic diagram showing a method for manufacturing a synthetic fiber through typical melt spinning.
Figure 2:
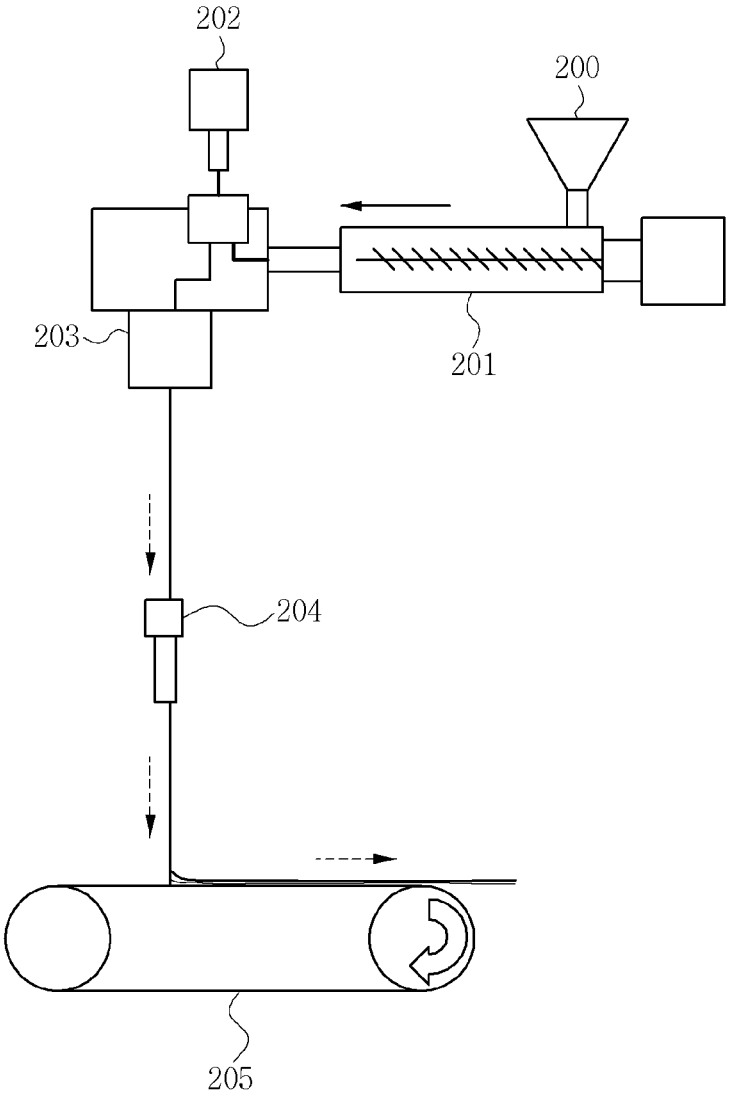
FIG. 2 is a schematic diagram showing a method for manufacturing a nonwoven fabric through an open type spunbond method using melt spinning.
Figure 3:
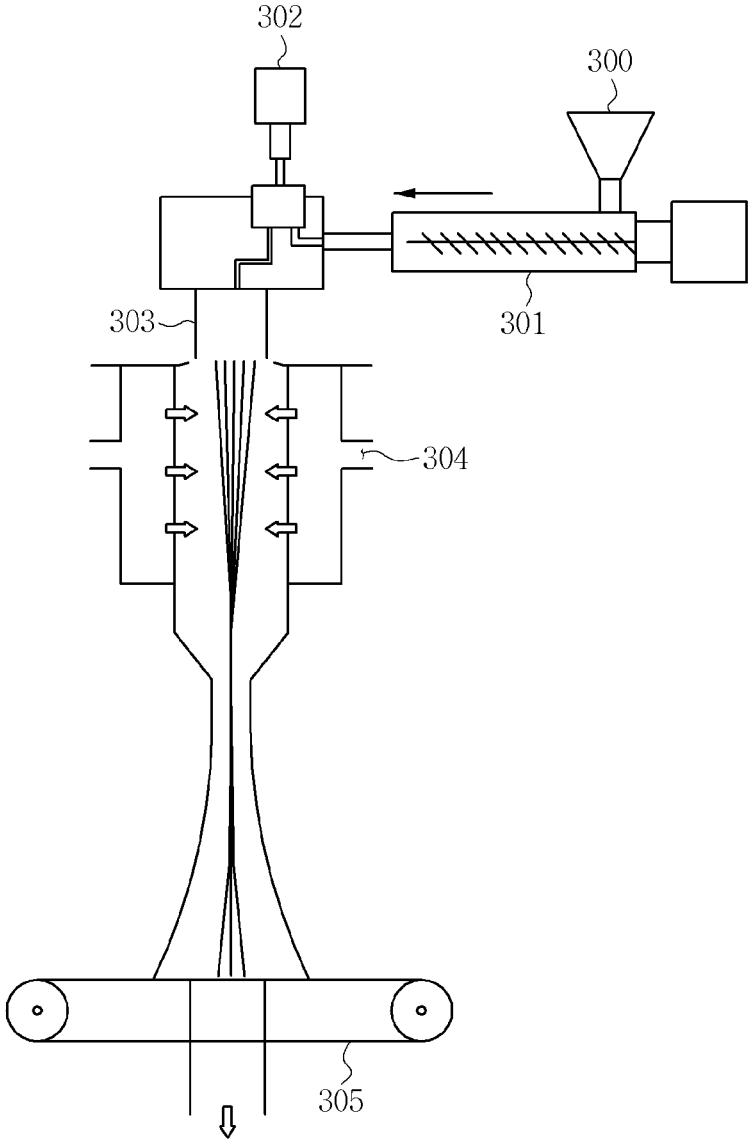
FIG. 3 is a schematic diagram showing method for manufacturing a nonwoven fabric through a closed type spunbond method using melt spinning.
Figure 4:
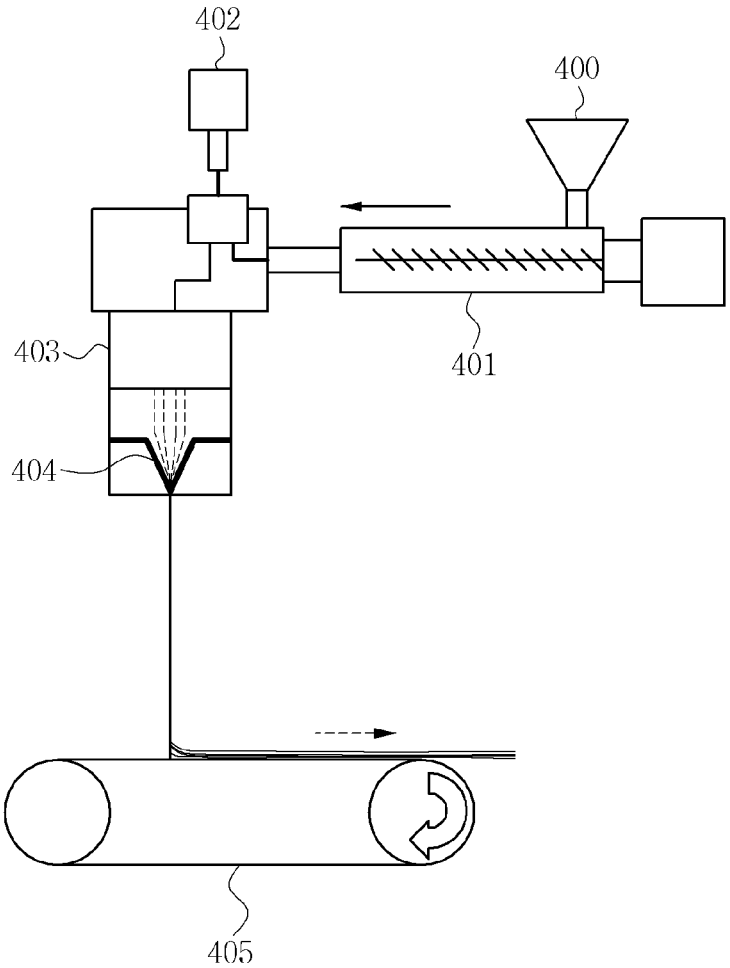
FIG. 4 is a schematic diagram showing method for manufacturing a nonwoven fabric through a meltblown method using melt spinning.
Figure 5:
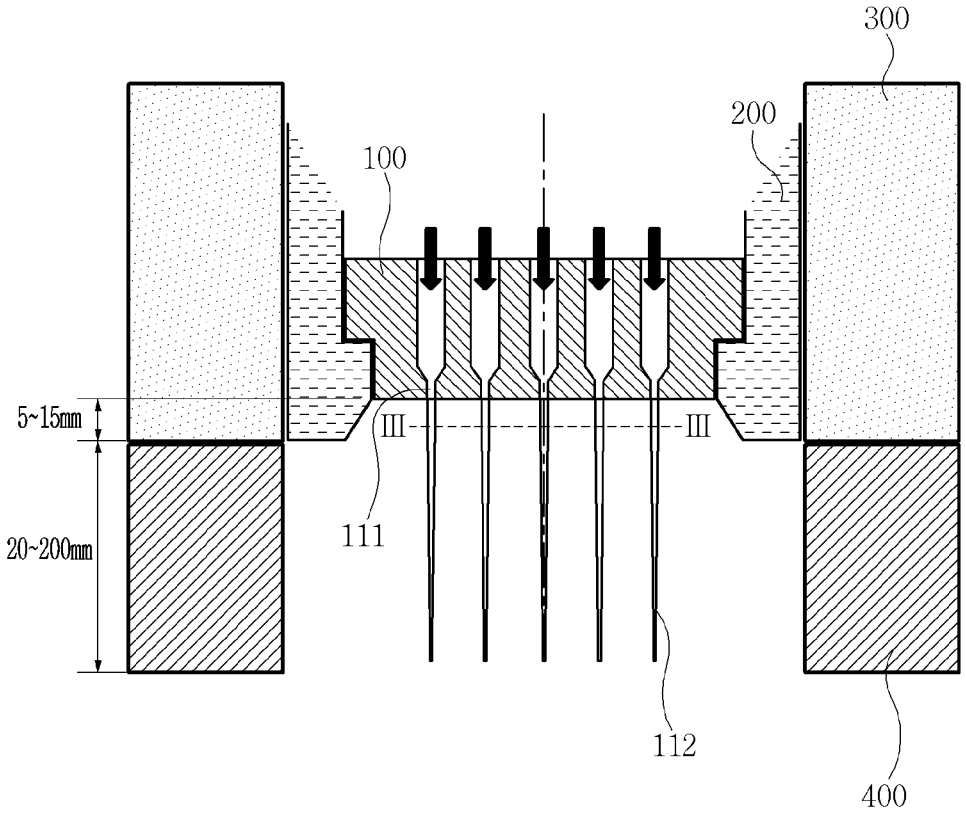
FIG. 5 is an enlarged view showing a nozzle and temperature keeping heaters located on the underside of the nozzle in a general melt spinning process.
Figure 6:
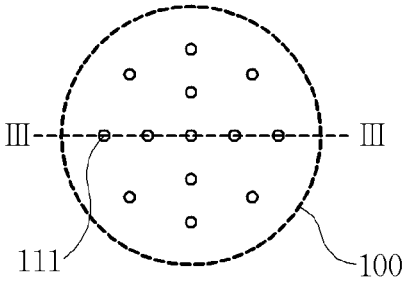
FIG. 6 is a sectional view taken along the line III-III of FIG. 5, wherein general hole type heaters are provided.

FIG. 5 shows a nozzle in a general melt spinning process, and in this case, a spinning device includes a pack body 200, a pack body heater 300 located on the outside of the pack body 200 to provide a heat source to the pack bod 200, and a spinning nozzle 100 located in the pack body 200 to spin a melted thermoplastic resin therefrom. Further, the spinning nozzle 100 has a plurality of spinning holes 111 formed on the underside thereof to allow the thermoplastic resin to be melt-spun to produce fibers. In this case, however, there is a limitation in providing fiber fineness, without any change in the physical properties of the thermoplastic resin.

The present invention relates to a method for manufacturing a melt-spun nonwoven fabric, in which fibers obtained by melt-spinning a thermoplastic polymer through a spinning nozzle having at least one or more nozzle holes are collected by high-speed air stream, including the steps of allowing the melt-spun fibers to pass through local nozzle heaters 41 of a nozzle heating mantle 40 located just on the underside of the spinning nozzle during spinning and allowing the melt-span fibers to be subjected to momentary local heating with a temperature difference of 0.1 to 1,000° C. from a temperature of a pack body 20.

According to the present invention, the local nozzle heaters 41 have a temperature difference of 0.1 to 1,000° C. from the temperature of the pack body 20, so that they have the temperatures equal to or higher than the pack body 20.

Further, the spinning nozzle 32 is fixed to the pack body 20 kept to a temperature of 50 to 400° C. through a heat source of a pack body heater 10, and a temperature of the spinning nozzle 32 is equal to or higher than that of the pack body heater 10. If the temperature of the pack body 20 is less than 50° C., most of resins can be hardened, without being melted, thereby making it difficult to perform the spinning, and if the temperature of the pack body 20 is higher than 400° C., the physical properties of the fibers are undesirably deteriorated by the drastic thermal decomposition of the resin. In this case, the temperature of the pack body heater 10 can be adjusted by means of an electric heater or heat transfer fluid.

In the method for manufacturing a melt-spun nonwoven fabric according to the present invention, during spinning, fibers F pass through the nozzle heating mantle 40 located just on the underside of the spinning nozzle 32.

Figure 7:
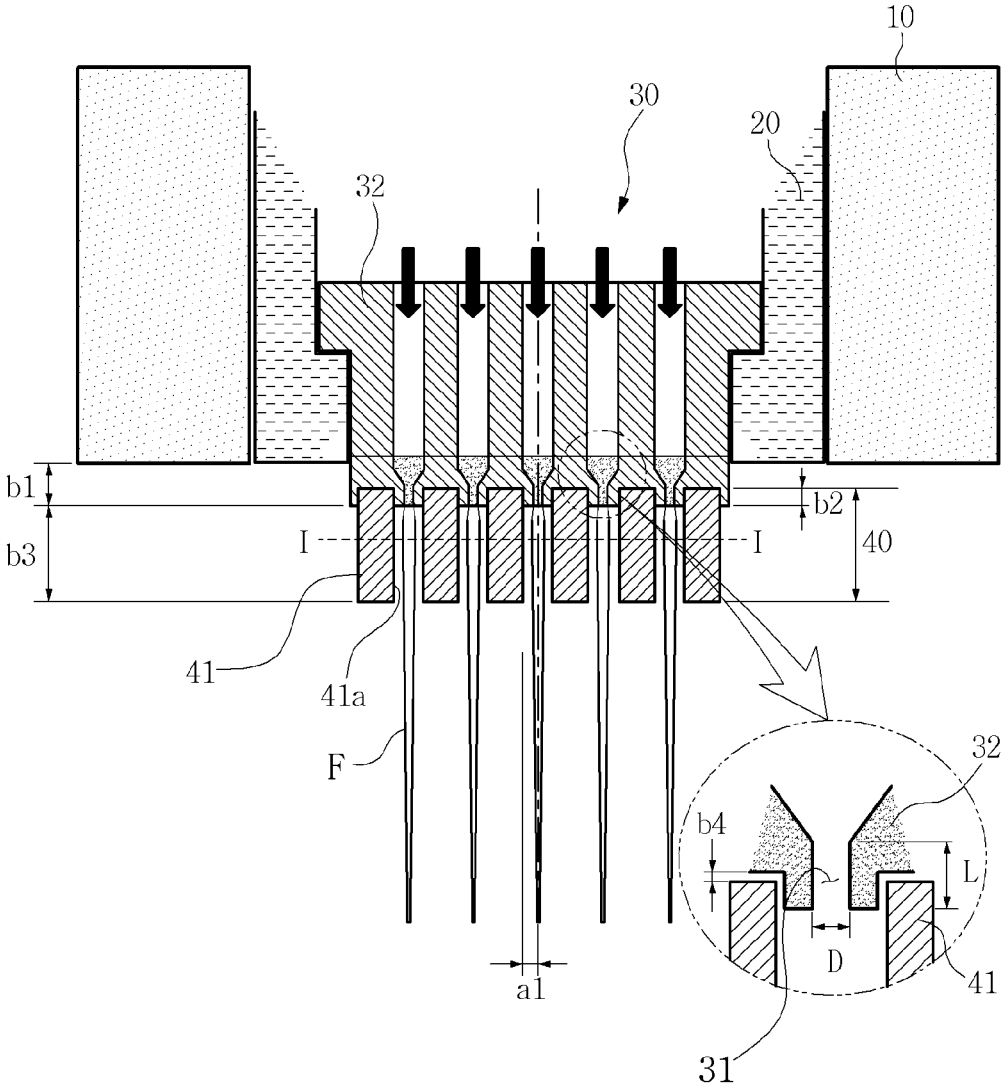
FIG. 7 is an enlarged view showing a nozzle and local nozzle heaters disposed just on the underside of the nozzle in a melt spinning process according to an embodiment of the present invention.
Figure 8:
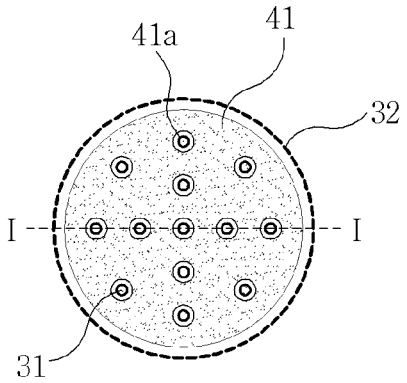
FIG. 8 is a sectional view taken along the line I-I of FIG. 7, wherein an example for the hole type local nozzle in heaters is provided.
Figure 9A:
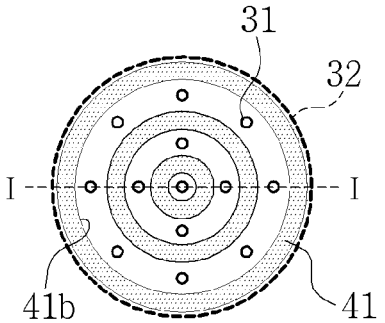
FIGS. 9A and 9B are sectional views taken along the line I-I of FIG. 7, wherein another example for the hole type local nozzle heaters is provided.
Figure 9B:
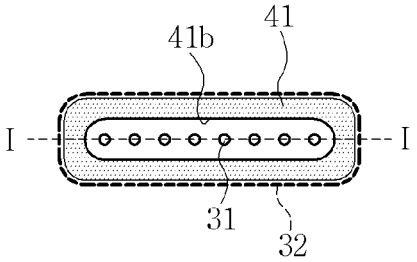

FIG. 7 is an enlarged view showing the nozzle heating mantle having the local nozzle heaters 41 located disposed just on the underside of the spinning nozzle 32, and in this case, the spinning nozzle 32 is located in the pack body 20 of a spinning device, and the pack body heater 10 is located on the outside of the pack body 20.

According to the present invention, further, a plurality of nozzle holes 31 is formed on the spinning nozzle 32 to produce the fibers F therefrom, and the nozzle heating mantle 40 is located under the nozzle holes 31 of the spinning nozzle 32 to directly and indirectly heat the fibers F during the spinning.

The local nozzle heaters 41 are configured to have heating holes 41*a* or 41*b* with the same configuration and number as the nozzle holes 31 of the spinning nozzle 32, so that the fibers F discharged during the spinning can be locally heated to a high temperature momentarily, while passing through the local nozzle heaters 41.

FIG. B is a sectional view taken along the line I-I of FIG. 7, wherein an example for the hole type local heaters is provided. The inner peripheries of the heating holes of the local nozzle heaters 41 are spaced apart from the centers of the nozzle holes 31 by 1 to 300 mm, while the heating holes maintain the structures of the nozzle holes 31 of the spinning nozzle 32, so that they can keep the temperature at the same distance from the centers of the nozzle holes 31 of the spinning nozzle 32 in a direction of 360°.

When the plurality of the nozzle holes 31 are arranged on the same radius as one another, further, the local nozzle heaters 41 are inserted between the neighboring nozzle holes 31.

The fibers F after spinning pass through the heating holes 41*a* or 41*b*, and in this case, they do not come into direct contact with the heating holes 41*a* or 41*b*.

In this case, if the sizes of the heating holes 41*a* or 41*b* are less than 1 mm from the centers of the nozzle holes 31 of the spinning nozzle 32, the local nozzle heaters 41 may come into contact with the fibers F to cause their contamination and the fracture of the fibers F, so that qualities of fibers and workability may become deteriorated and the degradation of the fibers F may occur due to their excessive exposure to heat. If a distance between the center of each nozzle hole 31 of the spinning nozzle 32 and each local nozzle heater 41 is more than 300 mm, heat is not sufficiently transferred to the fibers F so that it is hard to control the molecular entanglement in the melted fibers, thereby undesirably failing to achieve improvements in the physical properties of the fibers.

In this case, desirably, the distance all between the center of each nozzle hole 31 of the spinning nozzle 32 and each local nozzle heater 41 is more than 1 mm and less than 50 mm. If the distance a1 becomes distant, it is difficult to obtain the finely thin fibers.

Referring to the nozzle heating mantle 40 located just on the underside of the spinning nozzle, in specific, the nozzle heating mantle 40 is formed with a lower peripheral surface b1 of the spinning nozzle 31, which is inserted into the pack body 20 by 50 mm and is exposed to the outside of the pack body 20 by 300 mm with respect to the lower peripheral surface of the pack body 20, with an insertion depth b2 of 0 to 50 mm of each local nozzle heater 41, which comes into contact with the underside of the spinning nozzle 32 or is partially inserted into the spinning nozzle 32, and with a length b3 of 5 to 500 mm of each local nozzle heater 41. That is, the nozzle heating mantle 40 is formed with the insertion depth b2 of each local nozzle heater 41 whose portion is inserted into the underside of the spinning nozzle 32 and with the extension length b3 of each local nozzle heater 41 from the insertion depth b2.

Further, the length of each local nozzle heater 41 is in the range of 10 to 300 mm, desirably in the range of 50 to 250 mm.

In this case, as shown in the partially enlarged portion of FIG. 7, a gap b4 of 0 to 10 mm is formed between top of each local nozzle heater 41 inserted into the spinning nozzle 32 and the underside of the spinning nozzle 32 facing the local nozzle heater 41, so that the local nozzle heater 41 comes into direct contact with the surface of the spinning nozzle 32 (if the Gap b4 is 0 mm) or direct or indirect heating (conduction or radiation) is performed through the maximum gap b4 of 10 mm. Accordingly, the thermoplastic resin melted around the nozzle holes 31 in the spinning nozzle 32 before the spinning can be primarily directly heated (conduction).

That is, primarily, the nozzle heating mantle 40 directly heats (for example, through conduction) the thermoplastic resin melted around the nozzle holes 31 in the spinning nozzle 32 before the spinning by means of the insertion depths b2 of the local nozzle heaters 41 inserted into the underside of the spinning nozzle body 32 and the gap b4. Next, secondarily, the nozzle heating mantle 40 indirectly heats (for example, through radiation) the melted fibers F discharged from the spinning nozzle 32 after the spinning before they are hardened by means of the extension lengths b3 of 5 to 500 mm of the local nozzle heaters 41 from the insertion depths b2.

As mentioned above, the nozzle heating mantle 40 directly transfers high-temperature heat to the nozzle holes 31 of the spinning nozzle 32 through the change in the structure of the underside of the spinning nozzle 32 actually commercialized and indirectly heats the fibers F by means of the local nozzle heaters 41 located just on the underside of the spinning nozzle 32, thereby achieving optimized heat transfer through double heating. As a result, the molecular entanglement in the melted polymer can be controlled through the momentary local heating to the high temperature, thereby improving the elongation of the produced thermoplastic polymer fibers, delaying the cooling speeds of the fibers, increasing the spinning speeds of the fibers, and improving the productivity.

Figure 10:
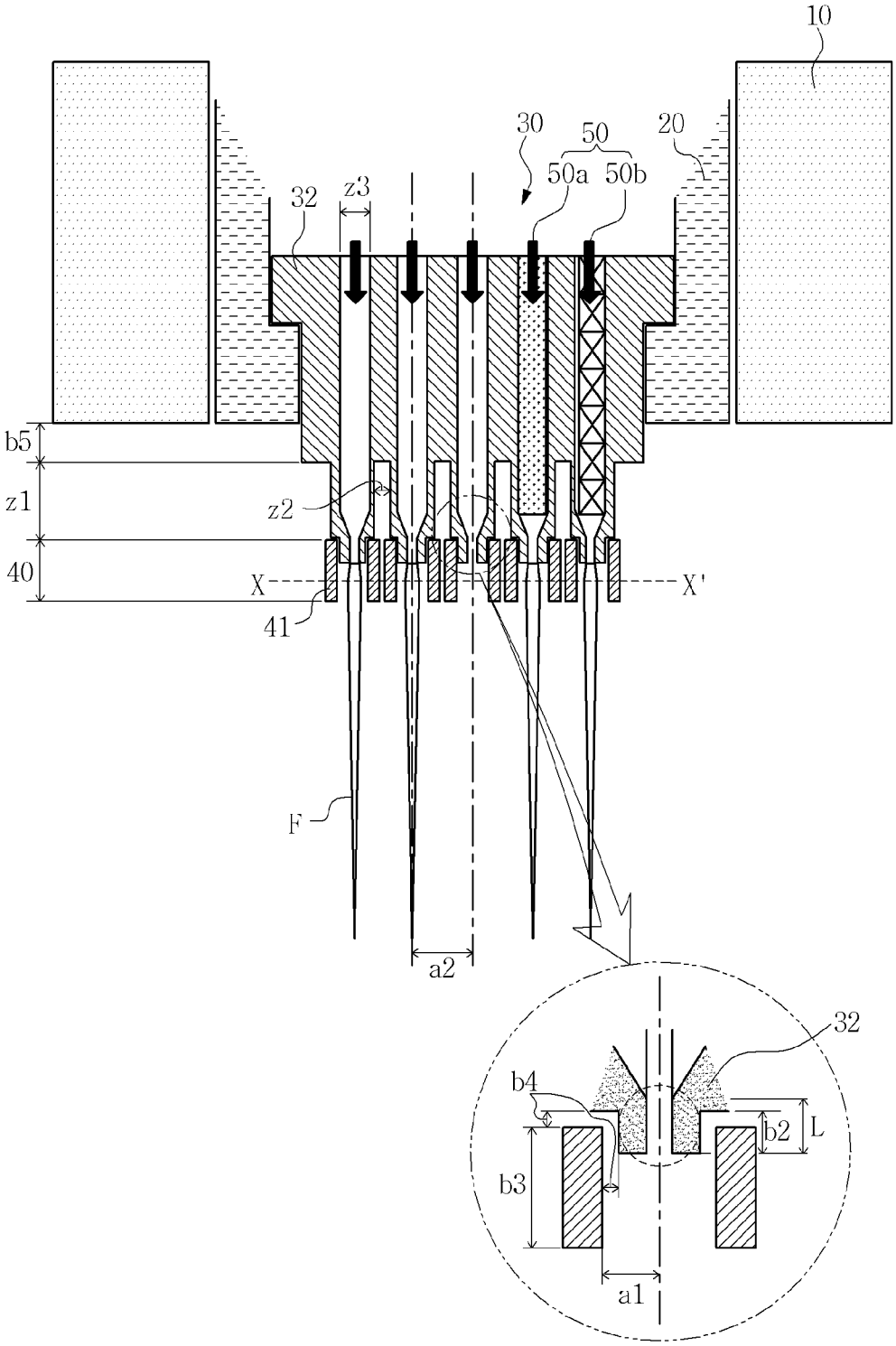
FIG. 10 is an enlarged view showing a nozzle and local nozzle heaters disposed just on the underside of the nozzle in a melt spinning process according to another embodiment of the present invention.
Figure 11:
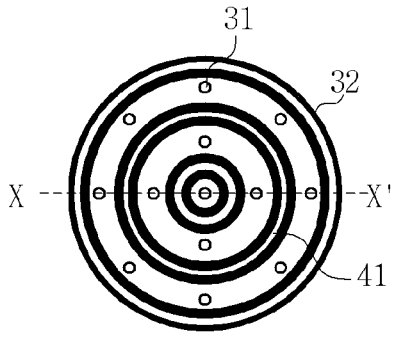
FIG. 11 is a sectional view taken along the line X-X' of FIG. 10, wherein still another example for the hole type local nozzle heaters is provided.

As the spinning nozzle 32 is extended from the underside thereof, as shown in FIG. 10, the nozzle heating mantle 40 located just on the underside of the spinning nozzle 32 has an additional extension distance z1 to the outlet of each nozzle hole from the underside of the spinning nozzle 32.

If the spinning nozzle 32 is further extended from the underside thereof, the heat of the nozzle heating mantle 40 can be collectively (effectively) transferred to the nozzle holes, thereby improving the local heating effectiveness to additionally reduce the shear pressure of the nozzle and increasing the spinning speed to optimize the production of the finely thin fibers.

In this case, a gap z2, through which air passes, is formed between the nozzle hole 31 formed in the additionally extended section and the neighboring nozzle hole 31. Accordingly, heat is uniformly transferred to each nozzle hole 31, and particularly, a local heating deviation between the outermost hole and the central hole can be minimized, thereby preventing the deviations in the denier and physical properties between the nozzle holes from occurring.

The additional extension distance z1 to the outlet of each nozzle hole from the underside of the spinning nozzle 32 is in the range of 0 to 100 mm, desirably 1 to 50 mm, and the gap z2 between the nozzle holes 31 in the extended section is in the range of 0 to 100 mm, desirably 1 to 10 mm.

The method for manufacturing a melt-spun nonwoven fabric according to the present invention is carried out by changing the lower structure of the spinning nozzle 32 actually commercialized to locate the nozzle heating mantle 40 just on the underside of the spinning nozzle 32, thereby lowering an initial investment cost and manufacturing the microfiber nonwoven fabric at a low cost.

So as to obtain the fineness of the fibers and the improvement in the productivity thereof, in the method for manufacturing a melt-spun nonwoven fabric according to the present invention, the nozzle heating mantle 40 has to optimize the staying time, flow rate, and shear rate of the melted polymer passing through the nozzle holes 31 of the spinning nozzle 32.

In this case, the staying time of the melted polymer per the nozzle hole 31 is desirably shorter than five seconds, and the discharge amount of the melted polymer per the nozzle hole is more than at least 0.001 g/min. In view of the productivity and the fineness of the fibers, desirably, the discharge amount of the melted polymer per the nozzle hole 31 is desirably in the range of 0.1 to 1 g/min, more desirably in the range of 0.3 to 0.7 g/min.

In the case of a polyester polymer, if the staying time is longer than five seconds, the melted polymer is exposed to the excessive heat for a long time, the degradation of the melted polymer is made, and if the discharge amount of the melted polymer is smaller than 0.001 g/min, the melted polymer is also exposed to the excessive heat for a long time, thereby causing the degradation thereof.

Further, a shear rate on the wall surface of the nozzle hole 31 of the spinning nozzle 32 is desirably in the range of 1,000 to 200,000/sec, more desirably in the range of 5,000 to 50,000/sec, and in this case, if the shear rate is less than 1,000/sec, the effectiveness of the control in the molecular orientation and structure of the melted polymer is reduced due to low shear stress. Contrarily, if the shear rate is more than 200,000/sec, melt fracture happens by the viscoelasticity of the melted polymer to cause the section of the fiber to be irregular, thereby making it difficult to manufacture the finely thin non-woven fabric.

In addition, a shear pressure on the nozzle is desirably kept to 10 to 200 bar, and so as to optimize the fineness of the fiber, it is desirably kept to 20 to 150 bar. If the shear pressure is less than 0 bar, a deviation in deniers of fibers with respect to the holes becomes severe due to the deviation in the discharge amounts from the nozzle holes, and contrarily, if the shear pressure is more than 200 bar, an excessive pressure is applied to the nozzle, so that the nozzle may be deformed or give damage to the neighboring portion thereof.

Further, a diameter D of each nozzle hole 31 of the spinning nozzle 32 is in the range of 0.01 to 1 mm in view of the fiber fineness. If the diameter D of the nozzle hole 31 is less than 0.01 mm, the nozzle hole may be clogged by means of foreign matters while being used, and further, it is hard to clean the nozzle hole. Contrarily, if the diameter D is more than 1 mm, the spinning draft is raised to cause a variation rate of the fiber section to be seriously increased, and further, it is hard to achieve the fiber fineness.

Also, the spinning nozzle 32 has a fluid mixer 50 located in an upper flow path pipe of each nozzle hole 31.

That is, the fluid mixers 50 are additionally located on the interiors of the upper flow path pipes of all nozzle holes constituting the spinning nozzle 32, and if they are located only on some of the nozzle holes 31, staying time and pressure differences among the nozzle holes 31 are generated to cause problems on fiber quality. Accordingly, the fluid mixers 50 have to be located on all of the nozzle holes 31.

For example, the fluid mixers 50 are static mixers 50*a*. The static mixer 50*a* is a convenient and economical device for mixing a fluid by means of a plurality of curved screw blades, which just moves along the pipe to consistently and uniformly mix the fluid, without any rotary part or special power, particularly to advantageously allow heat exchange between the outside and inside of the nozzle hole 31 to be easily conducted.

If the static mixer may have a shape appropriate to the dispersion in the nozzle hole 31, it is not limited in shape, but in consideration of a mixing rate, for example, the static mixer desirably has a shape of a screw or spiral. Further, a plurality of static mixers may be located in various directions in the nozzle. The static mixer is made of a known material, without any special limitation, and for example, the static mixer is made of a metal material by means of molding or casting.

For another example, metal powder, metal foams, or porous metal filters 50*b* may be used as the fluid mixers 50, thereby expecting the same effectiveness as the static mixers 50*a*.

Further, a ratio (L/D) of the length L of the nozzle hole 31 to the diameter D thereof is 2 to 10. If the ratio (L/D) of the length of the nozzle hole 31 to the diameter thereof is less than 2, external heat is not sufficiently transferred to the melted resin flowing in the nozzle hole, thereby making it hard to achieve the fiber fineness, and contrarily, the ratio (L/D) is more than 10, excessive heat is transferred directly to the melted resin flowing in the nozzle hole, thereby making the physical properties of the fiber deteriorated and increasing a pack pressure to cause bad spinnability.

In addition, the number of nozzle holes 31 of the nozzle body is more than 1, and the pitch between the nozzle holes 31 is more than 0.1 mm. According to the present invention, the section of the nozzle hole 31 is circular, but of course, the section of the nozzle hole 31 may have various shapes (for example, Y, +, −, O, and so on), without being limited thereto. Through a spinning spinneret including the spinning nozzle 32, also, two kinds of composite spinning technologies like sheath-core, side-by-side, islands-in-the-sea, and so on can be adopted.

According to the present invention, the structure and number of the heating holes 41*a* of the local nozzle heaters 41 are the same as those of the nozzle holes 31 of the spinning nozzle 32, and accordingly, the heating holes 41*a* may include various hole shapes like circle, oval, square, doughnut, and so on.

Further, typical electric heat lines are used as the local nozzle heaters 41, and for example, the local nozzle heaters 41 are any ones selected from cast copper/aluminum heaters, electromagnetic induction heaters, sheath heaters, flange heaters, cartridge heaters, coil heaters, near infrared ray heaters, carbon heaters, ceramic heaters, PTC heaters, quartz heaters, halogen heaters, nichrome wire heaters, light heaters like laser, ultrasonic heaters, and so on.

The polymer as the material which can be used in the method for manufacturing the melt-spun nonwoven fabric according to the present invention is selected from general purpose thermoplastic polymers, without any limitation, but desirably, the polymer is any one selected from a polyester polymer selected from the group consisting of polyethylene terephthalate (PET), polybutylene terephthalate (PBT), poly trimethylene terephthalate (PTT), polycyclohexane dimethanonol terephthalate (PCT), polyethylene naphthalate (PEN), and polyarylate; a polyamide polymer selected from the group consisting of nylon 6, nylon 6,6, nylon 4, and nylon 4, 6; a polyolefin polymer selected from polyethylene and polypropylene; and polyphenvlen sulfide (PPS), or a combination of two or more thereof.

According to the present invention, polypropylene and polyethylene terephthalate (PET) as desirable examples of the polymer are explained, but of course, the present invention may be not limited thereto.

The method for manufacturing the melt-spun nonwoven fabric according to the present invention is carried out by means of the open or closed type spunbond method.

After the melt-spun fibers are subjected to the momentary local heating to the high temperature, as described above, the method for manufacturing the melt-spun nonwoven fabric according to the present invention is carried out in the same manner as the conventional open or closed type spunbond method, in which the fibers are collected on a conveyor belt with high speed air stream and are then wound.

According to the present invention, that is, the fibers around the nozzle holes of the spinning nozzle and just under the spinning nozzle are directly and indirectly heated momentarily to the high temperature during the melt spinning, so that the melt flow index and spinline elongation viscosity of the thermoplastic resin discharged from the nozzle holes can be lowered, without reducing the molecular weight of the thermoplastic resin, thereby providing a microfiber nonwoven web formed of more fine fibers when compared to the conventional spunbond nonwoven fabric.

Accordingly, the conventional open or closed spunbond method is still utilized, so that the method according to the present invention has a low initial investment cost and enables mass production of high value and high functional microfiber nonwoven fabric.

Further, the melt spinning of the fibers is optimized through the momentary local heating to the high temperature to thus enable the control of the molecular weight and the adjustment of the spinning and heat treatment conditions, thereby manufacturing the microfiber nonwoven fabric having various fiber structure properties (strength, elongation, elasticity, and so on) and deniers, composite fibers (islands in the sea, sheath-core, side by side, and so on), and sectional shape (various sections).

Through the method manufacturing the melt-spun nonwoven fabric according to the present invention, in specific, it is possible that the melt flow index of the high viscosity thermoplastic resin discharged from the nozzle hole is lowered, without reducing the molecular weight of the thermoplastic resin, which is difficult in the conventional spunbond method, thereby decreasing the pressure of the spinning nozzle. Further, the spinline elongational viscosity of the thermoplastic resin is decreased to allow the tension of the fiber between the spinning nozzle and an ejector to be lowered, thereby manufacturing the microfiber nonwoven web made from fine fibers produced from the high viscosity resin when compared with the conventional open or closed type spunbond method.

So as to satisfy the same denier and physical properties as in the nonwoven fabric manufactured by the conventional spunbond method, further, the method for manufacturing the melt-spun nonwoven fabric according to the present invention can increase the amount of the thermoplastic polymer discharged initially as the spinning speeds of the melted fibers discharged from the spinning nozzle are raised by means of the local heating occurring when the fibers pass through the heating holes, thereby improving the productivity of the nonwoven fabric.

Accordingly, the method for manufacturing the melt-spun nonwoven fabric according to the present invention is carried out by allowing polypropylene (PP) having a melt flow index (MFI) of 3 to 900, desirably 3 to 300, and more desirably 3 to 100 to be subjected to a momentary local heating treatment to a high temperature, thereby providing the microfiber nonwoven web with fiber fineness.

In specific, the method for manufacturing the melt-spun nonwoven fabric according to the present invention is carried out by allowing the melt-spun fibers to be subjected to a momentary local heating treatment to a high temperature, so that the pack pressure is lowered to permit the thermoplastic polymer with high viscosity to be spunable, thereby providing the microfiber nonwoven web.

According to the present invention, as described above, polypropylene (PP) having MFI of 10 and 28 is subjected to the momentary local heating treatment to the high temperature during spinning. In the case of PP having the relatively high MFI of 10, it is spunable and provides the microfiber nonwoven web with fiber fineness. In this case, the MFI measurement method of the PP resin is obtained according to ASTM D1238 (MFI 230/2) law, and after the resin is melted at a temperature of 230° C. for six minutes, in specific, a pressure is applied to a nozzle having a diameter of 2 mm through a weight of 2.16 kg, thereby measuring the mass (g/10 min) of the resin discharged for 10 minutes.

In this case, the ejector 204 in the spunbond method serves to provide high-speed air stream so as to allow the discharged fibers to stretch, so that the fibers discharged from the spinneret are desirably located over a distance of 100 to 2,000 mm from the underside of the spinneret to the compressed air outlet of the elector. If the distance is less than 100 mm, the fibers enter the ejector in a state of being not sufficiently cooled, bad fiber fineness and breakage of the fibers frequently occur, and contrarily, if the distance is more than 2,000 mm, the sufficiently hardened fibers before the ejector have a high resistance with respect to air, thereby making it hard to achieve the fiber fineness. Through the position of the ejector, accordingly, the spinneret can apply stretched tension to a position where the cooling and hardening are not completely finished, thereby facilitating the fiber fineness and the orientation and crystallization thereof.

Further, the ejector 204 has various shapes like circle, rectangle, etc., but so as to prevent the fibers from being melted together or interfering with each other and to efficiently use an amount of air used in the high pressure air jet stream, the shape of the spinneret is desirably similar to the shape of the ejector. For example, in the case of a circular nozzle, the ejector is circular, and in the case of a rectangular nozzle, the ejector is rectangular.

According to the present invention, through the momentary local heating to the high temperature carried out just under the spinning nozzle during the melt spinning, polyolefin fibers having relatively low fine deniers, which are not obtained in the MFIs of the existing fibers with respect to the polyolefin fibers having various MFIs, can be provided.

In this case, the fineness of the microfiber nonwoven web satisfies a fineness value or less calculated by the following equation 1.

$$\text{Fineness } (\mu m)=94\times A^{(-0.71)} \qquad \text{Equation 1}$$

In the above, A indicates the MFI of the fibers constituting the spunbond nonwoven fabric when pure PP having no additive or modifying agent is used.

Through the method manufacturing the melt-spun nonwoven fabric according to the present invention, further, the polyethylene terephthalate (PET) having intrinsic viscosity (I.V.) of 0.5 to 3.0 measured according to ASTM D4603-3 law is subjected to the momentary local heating to the high temperature during spinning, thereby providing the microfiber nonwoven web with fiber fineness.

In this case, the fineness of the microfiber nonwoven web satisfies a fineness value or less calculated by the following equation 2.

$$\text{Fineness } (\mu m)=(34\times B)-12.7 \qquad \text{Equation 2}$$

In the above, B indicates the intrinsic viscosity of the fibers constituting the spunbond nonwoven fabric when pure PET having no additive or modifying agent is used.

Also, the method for manufacturing the melt-spun nonwoven fabric according to the present invention is used for the conventional nonwoven fabrics as well as the microfiber nonwoven webs, without any limitation, but more desirably, the method according to the present invention is usefully applied for filtering or sanitary materials including the microfiber nonwoven web manufactured thereby. The sanitary materials include general purpose disposable sanitary products for women or babies and face masks.

Hereinafter, the present invention will now be described in detail by way of particular examples.

The examples are provided to more specifically describe the present invention, and of course, the scope of the present invention is not limited thereto.

[Measurement Method]

Melt flow index (MFI) (g/10 min)

The MFI of PP was measured at a measuring temperature of 230° C. and a measuring load of 2.16 kg according to ASTM D1238.

Intrinsic viscosity (I.V.) (dl/g)

The I.V. of PET was measured in 60 wt % of phenol and 40 wt % of tetrachloroethane at a temperature of 30° C. according to ASTM D46030-3 law.

Draft

A draft value was calculated based on the following equation.

Fiber speed (spinning speed) from the elector/fiber discharge speed from nozzle outlet spinning speed (m/min)

The spinning speed V was calculated based on the following equation with the average denier of the fiber and an amount of resin D (hereinafter referred to as a single hole discharge amount) (g/min) discharged from the single hole of the spinneret set on various conditions.

$$\text{Spinning speed (m/min)}=(9000\text{ (m)}\times D\text{ (g/min)})/\text{denier}$$

–Strength (MPa) and elongation (%)

A tension speed of 300 m/min was applied to a sample with a length of 250 mm on the conditions of a temperature of 25° C. and relative humidity of 65% through Instron tester (Instron Engineering Corp., Canton, Mass.) according to ASTM D 885 test method, thereby measuring the tensile strength and elongation of the mixed fibers.

1. Manufacturing Polypropylene Microfiber Nonwoven Fabric

<Example 1> Manufacturing Microfiber Nonwoven Fabric

A polypropylene (PP) resin with MEI of 28 was put into an extruder and melted and extruded, and next, the melted PP resin was introduced into a spinning nozzle. During spinning, as shown in FIG. 7, the PP resin was subjected to a momentary local heating treatment to a high temperature through the local nozzle heaters located just on the underside of the spinning nozzle to manufacture the PP microfiber nonwoven fabric through the following spinning conditions.

(1) Spinning Conditions

Extruder temperature: 204° C.

Spinning pack temperature: 240° C.

Amount of discharge per nozzle hole: 0.35 g/min·hole

Air pressure of ejector: 250 kPa

The number of nozzle holes (in the nozzle): 24

Temperature of local nozzle heater: 50° C. higher than the pack body temperature Heating hole of local nozzle heater: spaced apart from the center of the nozzle hole within 5 mm.

Example 2

Example 2 was carried out in the same manner as Example 1, except that the air pressure of the ejector was 350 kPa, thereby manufacturing the PP microfiber nonwoven fabric.

Example 3

Example 3 was carried out in the same manner as Example 1, except that the amount of discharge per nozzle hole was 0.40 g/min·hole, thereby manufacturing the PP microfiber nonwoven fabric.

Example 4

Example 4 was carried out in the same manner as Example 1, except that high viscosity polypropylene resin with MEI of 10 was used, thereby manufacturing the PP microfiber nonwoven fabric.

Example 5

Example 5 was carried out in the same manner as Example 1, except that the additional extension distance Z1 was 30 mm, the gap (z2) between the holes in the extension section was 3 mm, and the air pressure of the ejector was 350 kPa, as shown in FIG. 10, thereby manufacturing the PP microfiber nonwoven fabric.

Example 6

Example 6 was carried out in the same manner as Example 5, except that the static mixers were used in the flow path pipes of the spinning nozzle, thereby manufacturing the PP microfiber nonwoven fabric.

Comparative Example 1

Comparative Example 1 was carried out in the same manner as Example 1, except that the spinning nozzle with no local nozzle heaters located just on the underside of the spinning nozzle as shown in FIG. 5 was used during the spinning in Example 1, thereby manufacturing the PP microfiber nonwoven fabric.

Comparative Example 2

Comparative Example 2 was carried out in the same manner as Comparative Example 1, except that the air pressure of the ejector was 350 kPa during the spinning in Comparative Example 1, thereby manufacturing the PP microfiber nonwoven fabric.

Comparative Example 3

Comparative Example 3 was carried out in the same manner as Comparative Example 1, except that the PP resin with MFI of 10 was used during the spinning in Comparative Example 1, thereby manufacturing the PP microfiber nonwoven fabric.

Experimental Example 1

The physical properties of the nonwoven fabrics manufactured through Examples 1 to 6 and Comparative Examples 1 to 3 are listed in the following Table 1.

TABLE 1

| | Polypropylene Non-woven fabric | Example 1 | Example 2 | Example 3 | Example 4 | Example 5 | Example 6 | Comparative example 1 | Comparative example 2 | Comparative example 3 |
|---|---|---|---|---|---|---|---|---|---|---|
| Operating Conditions | Melt Flow Index (MFI) | 28 | 28 | 28 | 10 | 28 | 28 | 28 | 29 | 10 |
| | Local nozzle heater | ○ | ○ | ○ | ○ | ○ | ○ | X | X | X |
| | Static mixer use | X | X | X | X | X | ○ | X | X | X |
| | Distance (a1) (mm) | 5 | 5 | 5 | 5 | 5 | 5 | — | — | — |
| | Heating heater length (b3) (mm) | 50 | 50 | 50 | 50 | 50 | 50 | — | — | — |
| | Additional extension length (z1) (mm) | 0 | 0 | 0 | 0 | 30 | 30 | — | — | — |
| | Distance (z2) between heating holes (mm) | 0 | 0 | 0 | 0 | 3 | 3 | — | — | — |
| | Discharge amount g/min · hole | 0.35 | 0.35 | 0.40 | 0.35 | 0.35 | 0.35 | 0.35 | 0.35 | 0.35 |
| | Ejector pressure (kPa) | 250 | 350 | 250 | 250 | 350 | 350 | 250 | 350 | 250 |
| Process value | Nozzle shear pressure (bar) | 38 | 38 | 46 | 112 | 31 | 42 | 72 | 72 | 203 |
| | Shear (ratesec$^{-1}$) | 8250 | 8250 | 9425 | 8250 | 8250 | 8250 | 8250 | 8250 | 8250 |
| | Draft [1] | 318 | 391 | 252 | 88 | 431 | 424 | 242 | — | — |
| | Spinning Speed [2] m/min | 3940 | 4840 | 3560 | 1085 | 5340 | 5250 | 3000 | — | — |
| Physical properties of Spunbond fiber | Diameter (um) | 10.8 | 9.7 | 12.1 | 20.5 | 9.2 | 9.3 | 12.3 | — | — |
| | Fineness[3] | 0.80 | 0.65 | 1.01 | 2.90 | 0.59 | 0.60 | 1.05 | — | — |
| | Strength (MPa) | 203 | 237 | 195 | 270 | 225 | 229 | 211 | — | — |
| | Elongation (%) | 162 | 154 | 173 | 180 | 158 | 164 | 160 | — | — |
| | Melt Flow Index (MFI) | 31 | 31 | 30 | 11 | 30 | 29 | 30 | — | — |
| Web output rate (g/min) | | 8.3 | 8.4 | 9.6 | 8.4 | 8.3 | 8.3 | 8.4 | — | — |

[1] Draft = fiber speed (spinning speed) from ejector/fiber discharge speed from outlet of nozzle

[2] Spinning speed (m/min): calculated based on calculated fineness value and discharge amount

[3] Fineness: calculated in consideration of a value obtained by measuring a diameter and a yarn weight of 0.98

As appreciated from Table 1, it can be checked that the reduction in the shear pressure of the nozzle, the increase in the spinning speed, and the decrease in the fineness in Example 1 appear when compared to Comparative Example 1, thereby achieving the fiber fineness and allowing the physical properties and molecular weight of the fiber to be similar to those in Comparative Example 1 to thus cause no heat decomposition upon the local heating to the high temperature.

It can be appreciated that in Example 2, it is possible to perform high speed spinning, which is hard in Comparative Example 2, and increase in the spinning speed appears when compared to Example 1, thereby achieving the fiber fineness and allowing the physical properties and molecular weight of the fiber to be improved or similar to those in Example 1 to thus cause no heat decomposition upon the local heating to the high temperature.

It can be appreciated that in Example 3, it is possible to produce the fibers with the similar fineness or physical properties to each other at a relatively higher spinning speed, when compared to Comparative Example 1, and the web output rate per unit time is increased to raise the web productivity.

It can be checked that in Example 4, the resin having high viscosity (high molecular weight and low MFI) can be spun when compared to Comparative Example 3.

It can be appreciated that in Example 5, the local heating effectiveness is improved as the shear pressure of the nozzle is additionally a reduced, the spinning speed is raised to optimize the fiber fineness, and the physical properties and molecular weights of the fibers are similar to each other, when compared to Example 2.

It can be appreciated that in Example 6, the shear pressure of the nozzle is increased by means of the occurrence of the resistance in the flow paths, which is caused by the application of the static mixers, the spinning speeds and fineness of the fibers are similar to each other, and the decrease in the molecular weight of the fiber is improved, when compared to Example 5.

In Comparative Examples 2 and 3, further, it is impossible to perform spinning.

In conclusion, it can be checked that the microfiber nonwoven fabrics manufactured by Examples 1 to 6 achieve the fiber fineness, do not have any change in the melt flow indexes to thus have no decrease in the molecular weight, and do not have any decrease in the mechanical properties like toughness, ductility, and so on.

2. Manufacturing Polyethylene Trephthalate (PET) Microfiber Nonwoven Fabric

<Example 7> Manufacturing Microfiber Nonwoven Fabric

A polyethylene terephthalate (PET) resin with intrinsic viscosity (I.V.) of 0.65 was put into an extruder and melted and extruded, and next, the melted PET resin was introduced into a spinning nozzle. During spinning, as shown in FIG. 7, the PET resin was subjected to a momentary local heating treatment to a high temperature through the local nozzle heaters located just on the underside of the spinning nozzle to manufacture the PET microfiber nonwoven fabric through the following spinning conditions.

(1) Spinning conditions

Extruder temperature: 290° C.

Spinning pack temperature: 290° C.

Amount of discharge per nozzle hole: 0.40 g/min·hole

Air pressure of ejector: 300 kPa (3 bar)

The number of nozzle holes (in the nozzle): 24

Temperature of local nozzle heater: 50° C. higher than the pack body temperature Heating hole of local nozzle heater: spaced apart from the center of the nozzle hole within 5 mm.

Example 8

Example 8 was carried out in the same manner as Example 7, except that the air pressure of the elector was 400 kPa, thereby manufacturing the PET microfiber nonwoven fabric.

Example 9

Example 9 was carried out in the same manner as Example 7, except that the amount of discharge per nozzle hole was 0.46 g/min·hole, thereby manufacturing the PET microfiber nonwoven fabric.

Example 10

Example 10 was carried out in the same manner as Example 7, except that high viscosity PET resin with intrinsic viscosity (I.V.) of 1.20 was used, thereby manufacturing the PET microfiber nonwoven fabric.

Example 11

Example 11 was carried out in the same manner as Example 7, except that the additional extension distance Z1 was 30 mm, the gap (z2) between the holes in the extension section was 3 mm, and the air pressure of the ejector was 400 kPa, as shown in FIG. 10, thereby manufacturing the PET microfiber nonwoven fabric.

Example 12

Example 12 was carried out in the same manner as Example 11, except that the static mixers were used in the flow path pipes of the spinning nozzle, thereby manufacturing the PET microfiber nonwoven fabric.

Comparative Example 4

Comparative Example 4 was carried out in the same manner as Example 7, except that the spinning nozzle with no local nozzle heaters located just on the underside of the spinning nozzle as shown in FIG. 5 was used during the spinning in Example 7, thereby manufacturing the PET microfiber nonwoven fabric.

Comparative Example 5

Comparative Example 5 was carried out in the same manner as Comparative Example 4, except that the air pressure of the ejector was 400 kPa during the spinning in Comparative Example 4, thereby manufacturing the PET microfiber nonwoven fabric.

Comparative Example 6

Comparative Example 6 was carried out in the same manner as Comparative Example 4, except that the polypropylene resin with intrinsic viscosity of 1.2 was used during the spinning in Comparative Example 4, thereby manufacturing the PET microfiber nonwoven fabric.

Experimental Example 2

The physical properties of the nonwoven fabrics manufactured through the Examples 7 to 12 and the Comparative Examples 4 to 6 are listed in the following Table 1.

It can be checked that in Example 10, it is possible to spin the resin having high viscosity, which is impossible in Comparative Example 4.

It can be appreciated that in Example 11, the shear pressure of the nozzle is additionally reduced to improve the local heating effectiveness, and the spinning speed is raised to optimize the fiber fineness, when compared to Example 2.

TABLE 2

| PET examples | | Example 7 | Example 8 | Example 9 | Example 10 | Example 11 | Example 12 | Comparative example 4 | Comparative example 5 | Comparative example 6 |
|---|---|---|---|---|---|---|---|---|---|---|
| Operating Conditions | Intrinsic Viscosity (I.V.) | 0.65 | 0.65 | 0.65 | 1.20 | 0.65 | 0.65 | 0.65 | 0.65 | 1.20 |
| | Local nozzle heater | ○ | ○ | ○ | ○ | ○ | ○ | X | X | X |
| | Static mixer use | X | X | X | X | X | ○ | X | X | X |
| | Distance (a1) (mm) | 5 | 5 | 5 | 5 | 5 | 5 | — | — | — |
| | Heating heater length (b3) (mm) | 50 | 50 | 50 | 50 | 50 | 50 | — | — | — |
| | Additional extension length (z1) (mm) | 0 | 0 | 0 | 0 | 30 | 30 | — | — | — |
| | Distance (z2) between heating holes (mm) | — | — | — | — | 3 | 3 | — | — | — |
| | Discharge amount g/min · hole | 0.40 | 0.40 | 0.46 | 0.40 | 0.40 | 0.40 | 0.40 | 0.40 | 0.40 |
| | Ejector pressure (kPa) | 300 | 400 | 300 | 300 | 400 | 400 | 300 | 400 | 300 |
| Process value | Nozzle shear pressure (bar) | 43 | 48 | 58 | 127 | 39 | 50 | 86 | 86 | 215 |
| | Shear (ratesec$^{-1}$) | 7200 | 7200 | 8270 | 7200 | 7200 | 7200 | 7200 | — | — |
| | Draft [1] | 359 | 513 | 318 | 104 | 585 | 575 | 312 | — | — |
| | Spinning Speed [2] m/min | 3870 | 5540 | 3940 | 1125 | 6320 | 6210 | 3365 | — | — |
| Physical properties of Spunbond fiber | Diameter (um) | 9.8 | 8.2 | 10.4 | 18.1 | 7.7 | 7.7 | 10.5 | — | — |
| | Fineness[3] | 0.93 | 0.65 | 1.05 | 3.20 | 0.57 | 0.58 | 1.07 | — | — |
| | Strength (MPa) | 315 | 330 | 319 | 360 | 335 | 333 | 324 | — | — |
| | Elongation (%) | 106 | 102 | 120 | 94 | 98 | 103 | 113 | — | — |
| | Intrinsic Viscosity (I.V.) | 0.60 | 0.61 | 0.61 | 0.91 | 0.61 | 0.62 | 0.61 | — | — |
| Web output rate (g/min) | | 9.6 | 9.5 | 11.5 | 9.6 | 9.6 | 9.6 | 9.6 | — | — |

[1] Draft = fiber speed (spinning speed) from ejector/fiber discharge speed from outlet of nozzle
[2] Spinning speed (m/min): calculated based on calculated fineness value and discharge amount
[3] Fineness: calculated in consideration of a value obtained by measuring a diameter and a yarn weight of 0.98

As appreciated from Table 2, it can be checked that when the physical properties of Example 7 and Comparative Example 4 according to the existence of the local nozzle heaters located just on the underside of the nozzle are compared to each other in the same spinning conditions, the reduction in the shear pressure of the nozzle, the increase in the spinning speed, and the decrease in the denier in Example 7 appear when compared to Comparative Example 1, thereby achieving the fiber fineness and allowing the physical properties and molecular weight of the fiber to be similar to those in Comparative Example 4 to thus cause no heat decomposition upon the local heating to the high temperature.

It can be appreciated that in Example 8, the air pressure of the ejector raised in the same conditions, thereby producing fine microfiber (of 8.2 μm) nonwoven fabric.

It can be appreciated that in Example 9, if the discharge amount from the nozzle is raised to produce the same fineness, the web output rate is increased. In this case, the microfiber nonwoven fabric according to the present invention does not have any decrease in the physical properties and the intrinsic viscosity of the fiber.

It can be appreciated that in Example 12, the shear pressure of the nozzle is increased by means of the occurrence of the resistance in the flow paths, which is caused by the application of the static mixers, the spinning speeds and deniers of the fibers are similar to each other, and the decrease in the molecular weight of the fiber is improved, when compared to Example 5.

In Comparative Examples 5 and 6, further, it is impossible to perform spinning.

In conclusion, the microfiber nonwoven fabrics manufactured by Examples 7 to 12 achieve the fiber fineness, do not have any change in the melt flow indexes to thus have no decrease in the molecular weight, and do not have any decrease in the mechanical properties like toughness, ductility, and so on.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

It is therefore intended that the scope of the invention be limited not by this detailed description, but rather by the claims appended hereto.

EXPLANATION ON REFERENCE NUMERALS

| | |
|---|---|
| 10: pack body heater | 20: pack body |
| 30: melted polymer resin | 31: nozzle hole |
| 32: spinning nozzle | 40: nozzle heating mantle |
| 41: local nozzle heater | 41a, 41b: heating hole |
| 50: fluid mixer | |
| 100, 200, 300, 400: hopper | 101, 201, 301, 401: extruder |
| 102, 202, 302, 402: gear pump | 103, 203, 303, 403: nozzle |
| 104: roller | 204: ejector |
| 304: duct | 404: meltblown die |
| 105, 205, 305, 405: winder | |

INDUSTRIAL APPLICABILITY

According to the present invention, the method for manufacturing the melt-spun nonwoven fabric provides the microfiber nonwoven web with high fiber fineness when compared to the spunbond nonwoven fabric, while still utilizing the conventional spunbond method, so that the method according to the present invention can be applied to fields for producing high value and high functional microfiber nonwoven fabrics at a low initial investment cost.

The invention claimed is:

1. A method for manufacturing a melt-spun nonwoven fabric, in which fibers obtained by melt-spinning a thermoplastic polymer through a spinning nozzle having at least one or more nozzle holes are collected by high-speed air stream according to a spunbond method, the method comprising the steps of:

allowing the melt-spun fibers to pass through local nozzle heaters of a nozzle heating mantle located just on the underside of the spinning nozzle during the spinning; and allowing the melt-spun fibers to be subjected to momentary local heating with a temperature difference of 0.1 to 1,000° C. from a temperature of a pack body, wherein the spinning nozzle has a fluid mixer located in an upper flow path pipe of each nozzle hole.

2. The method according to claim 1, wherein the local nozzle heaters have the corresponding number of heating holes to the at least one or more nozzle holes in such a manner as to be spaced apart from the centers of the nozzle holes by 1 to 300 mm.

3. The method according to claim 2, wherein if the nozzle holes are arranged with a plurality of hole layers on the same radius as one another to allow the local nozzle heaters to be inserted into the neighboring hole layers to band forms, the local nozzle heaters have band type heating holes arranged in series within a distance of 1 to 300 mm from the centers of the nozzle holes.

4. The method according to claim 1, wherein the thermoplastic polymer is any one selected from a polyester polymer selected from the group consisting of polyethylene terephthalate (PET), polybutylene terephthalate (PBT), poly trimethylene terephthalate (PTT), polycyclohexane dimethanonol terephthalate (PCT), polyethylene naphthalate (PEN), and polyarylate; a polyamide polymer selected from the group consisting of nylon 6, nylon 6,6, nylon 4, and nylon 4, 6; a polyolefin polymer selected from polyethylene and polypropylene; and polyphenylen sulfide (PPS), or a combination of two or more thereof.

5. The method according to claim 1, wherein the nozzle heating mantle is formed with a lower peripheral surface of the spinning nozzle, which is inserted into the pack body by 50 mm and is exposed to the outside of the pack body by 300 mm with respect to the lower peripheral surface of the pack body, with an insertion depth of 0 to 50 mm of each local nozzle heater, which comes into contact with the underside of the spinning nozzle or is partially inserted into the spinning nozzle, and with a length of 5 to 500 mm of each local nozzle heater, the nozzle heating mantle being formed with the insertion depth of each local nozzle heater whose portion is inserted into the underside of the spinning nozzle and with the extension length of each local nozzle heater from the insertion depth.

6. A method for manufacturing a melt-spin nonwoven fabric, in which fibers obtained by melt-spinning a thermoplastic polymer through a spinning nozzle having at least one or more nozzle holes are collected by high-speed air stream according to a spunbond method, the method comprising steps of:

allowing the melt-fibers to pass through local nozzle heaters of a nozzle heating mantle located just on an underside of the spinning nozzle during the spinning; and allowing the melt-spun fibers to be subjected to momentary local heating with a temperature difference of 0.1 to 1,000° C. from a temperature of a pack body, wherein the nozzle heating mantle is formed with a lower peripheral surface of the spinning nozzle, which is inserted into the pack body by 50 mm and is exposed to an outside of the pack body by 300 mm with respect to the lower peripheral surface of the pack body, with an insertion depth of 0 to 50 mm of each local nozzle heater, which comes into contact with the underside of the spinning nozzle or is partially inserted into the spinning nozzle, and with a length of 5 to 500 mm of each local nozzle heater, the nozzle heating mantle being formed with the insertion depth of each local nozzle heater whose portion is inserted into the underside of the spinning nozzle and with an extension length of each local nozzle heater from the insertion depth, wherein additional extension distance to an outlet of each nozzle hole from the underside of the spinning nozzle is in a range of 0 to 100 mm, and a gap between the nozzle holes in an extended section is in a range of 0 to 100 mm.

* * * * *